United States Patent [19]

Creger et al.

[11] 4,262,518

[45] Apr. 21, 1981

[54] TUBE EXPANDER AND METHOD

[75] Inventors: Todd D. Creger, Peoria; Steven R. Nelson, Dunlap; Paul L. Wright, Peoria, all of Ill.

[73] Assignee: Caterpillar Tractor Co., Peoria, Ill.

[21] Appl. No.: 58,058

[22] Filed: Jul. 16, 1979

[51] Int. Cl.[3] ..... B21D 41/02

[52] U.S. Cl. ..... 72/393; 29/727

[58] Field of Search ..... 29/157.4, 727; 72/393; 279/2 R

[56] References Cited

U.S. PATENT DOCUMENTS

| | | | |
|---|---|---|---|
| 1,719,720 | 7/1929 | Olsen | 72/393 |
| 2,357,123 | 8/1944 | Maxwell | 72/393 |
| 2,991,674 | 7/1961 | Uhl | 72/393 |
| 3,225,581 | 12/1965 | Hinderer | 72/316 |
| 3,260,097 | 7/1966 | Hilton | 72/393 |
| 3,385,087 | 5/1968 | Huth | 72/393 |
| 3,866,457 | 2/1975 | Bagby | 72/370 |
| 3,888,102 | 6/1975 | Nigido | 72/393 |
| 4,212,186 | 7/1980 | Blatter | 72/393 |

*Primary Examiner*—Lowell A. Larson
*Attorney, Agent, or Firm*—Robert A. McFall

[57] ABSTRACT

A tube expander (10) for extrudably deforming tubes (12) into conformity with a flange (16) has a plurality of first and second forming members (28,30) circumferentially arranged on a mandrel (20). In an initial position, the forming members (28,30) are axially offset and radially retracted for ease of insertion into the bore (13) of the tube (12). After insertion, the mandrel (20) is partially withdrawn by an actuator (64) and by such action, the forming members (28,30) are brought together in an abutting, axially aligned, and radially expanded relationship such that workpiece-contacting surfaces (40,42) of the forming members (28,30) are brought into substantially continuous circumferential contact with the tube bore 13. The workpiece-contacting surfaces (40,42) are maintained in continuous circumferential contact with the tube bore 13 as the forming members (28,30) and the mandrel (20) are withdrawn from the tube end, thereby uniformly extruding the tube.

5 Claims, 7 Drawing Figures

VI
VI
REL
REL

VII
VII
REL
REL

TUBE EXPANDER AND METHOD

TECHNICAL FIELD

The present invention relates to a tool that is particularly useful for expanding tubular or hollow workpieces, and more particularly to a segmented tool providing substantially complete and continuous contact with the workpiece throughout the zone of deformation.

BACKGROUND ART

Tube expanders of various constructions are conventionally used to expand the walls of hollow-shaped workpieces. The expansion may be free in which deformation of the external surface is not limited, or by containment in which deformation is limited by an external structure.

One form of tube expander is a rotary swage in which a plurality of rollers are mounted about a central mandrel in such a way as to cause the rollers to expand radially outwardly against the inner wall of the tube coincident with rotation of the mandrel and rollers about a central axis. The passing of successive rollers over a portion of the inner wall surface, coupled with the resultant spring-back or resistance of the wall to permanent deformation, acts as a series of blows or strikes to incrementally deform the tube into an expanded-diameter shape.

Rotary swage tube expanders have proven to be effective on thin-wall tubes. However, it has been found that under the greater forces needed to deform thicker-walled tubing the rollers have a tendency to pick-up material from the inner wall surface and to produce a condition known as spalling. In addition, a greater number of incrementally provided blows by rotary passes of the rollers over the wall surface are needed. Such additional working has a tendency to produce work hardening of the deformed material which can result in the subsequent failure of the workpiece.

Another form of tube expander is a simple solid punch having a shape substantially equal to the desired dimension of the expanded workpiece. This form of expander is generally drawn or pushed through the workpiece and the wall is axially extruded to the desired shape. Solid punch-tube expanders are again effective if the deformation forces are of a relatively low magnitude. Fixturing of the workpiece to resist the axial force of the entering punch must be provided. The fixturing must also prevent the tube itself from buckling under high columnar loading. The deformation force available is also limited by the physical and material limitations of the workpiece itself.

Yet another form of tube expander is found in a tool having a plurality of forming members mounted about a cone-shaped mandrel. As the mandrel carrying the forming members is forced into the workpiece, the mandrel cone radially displaces the forming members mounted thereon into forcible contact with the wall inner surface. If the cone is urged into the tube via a series of blows, such as from a hammer, cold-working of the wall and the aforementioned problems attendant thereto may again result. Deforming the tube by a single blow produces radial extrusion, which if not closely controlled may result in thinning and cracking in the deformed zone.

Another serious problem inherent with this latter form of prior art tube expander is attributable to separation of the forming elements as they are radially outwardly displaced by the cone-shaped mandrel. Separation of the segments produces a non-continuous peripheral contact force acting on the wall inner surface. Such non-uniform contact forces may form ridges or other surface anomalies deleterious to the effective future use of the product.

What is desired is a tube expander providing continuous circumferential contact with the workpiece throughout the annular deformation zone. Also, preferably, such a tool would be readily and easily insertable into a proximal end of the workpiece, and would accomplish the deformation by controllably extruding the desired portion in a single operation.

DISCLOSURE OF INVENTION

In accordance with one aspect of the present invention, a tube expander includes a mandrel at least partially disposed within a housing. A plurality of first and second forming members are slidably mounted on the mandrel and are axially separable in response to axial translation of the mandrel with respect to the housing.

In another aspect of the present invention, a method of expanding a hollow workpiece is provided including the bringing together of a plurality of forming members into an abutting relationship after insertion of the members into a workpiece, and thereby deforming the workpiece while maintaining the members in their abutting relationship.

BEST MODE FOR CARRYING OUT THE INVENTION

Figure 1:
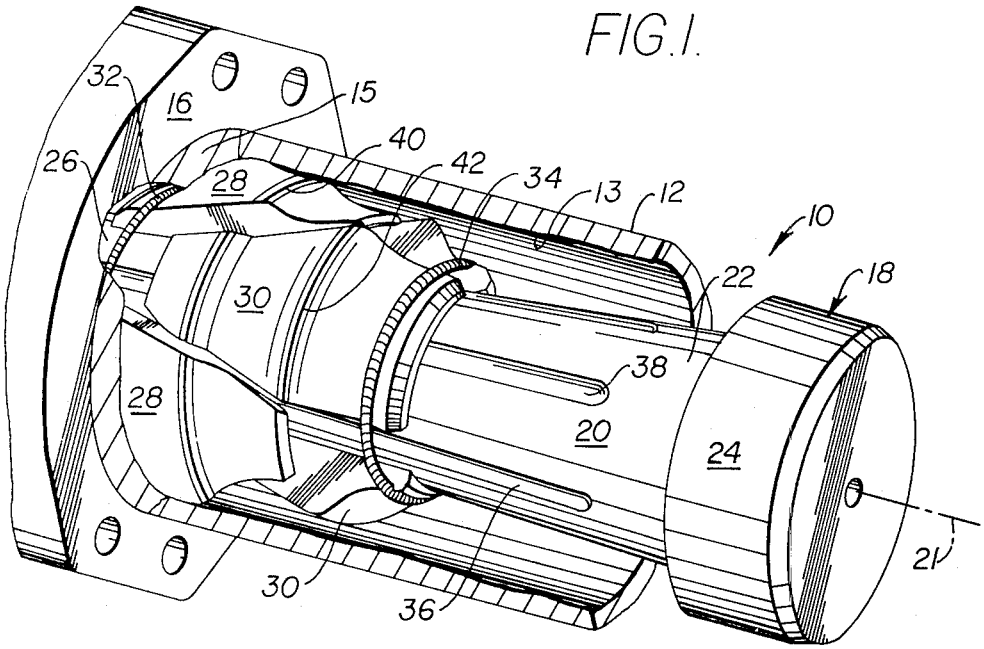
FIG. 1 is a three-dimensional view of a portion of the tube expander of the present invention with the forming members of the expander in a radially retracted, axially offset, and non-abutting position.
Figure 2:
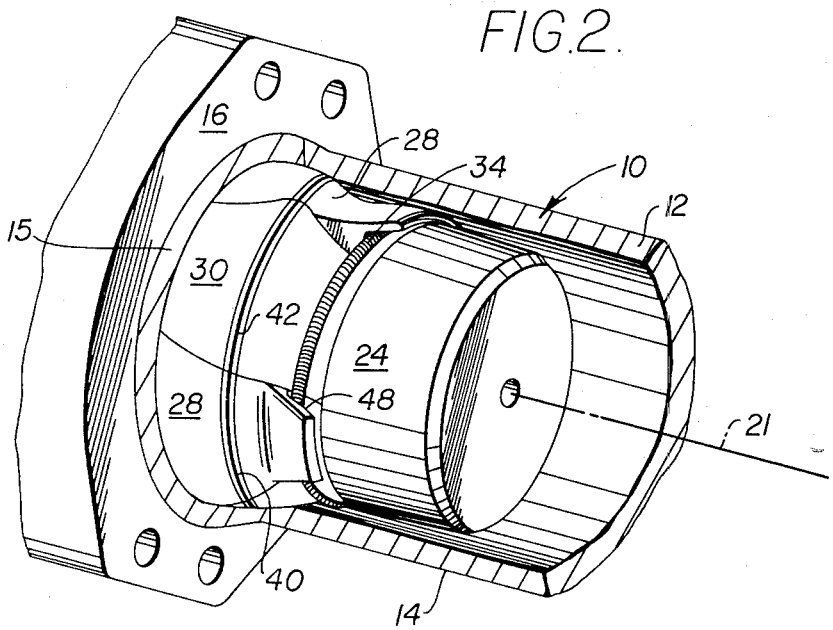
FIG. 2 is a three-dimensional view of a portion of the tube expander of the present invention with the forming members of the expander in a radially expanded, axially aligned, and abutting position.

In the embodiment of the present invention shown in FIGS. 1 and 2, a tube expander 10 is disclosed in conjunction with a hollow workpiece such as a tube 12 having an inner bore 13, an outer surface 14, and an end portion 15 disposed within a flange 16. As may be noted from the drawing, the tube expander is of elongate construction sufficient for a distal end 18 thereof to extend a distance into the tube 12. The expander includes a tapered mandrel 20 having a longitudinal centerline 21. The mandrel also has a first diameter 22 adjacent an end cap 24 screw threadably secured to the mandrel at the extremity of the distal end 18, and a second diameter 26 of a lesser or smaller dimension than the first diameter 22, spaced from the end cap.

A plurality of first forming members 28 and second forming members 30 are slidably mounted on the mandrel 20 and are respectively maintained in intimate contact with the mandrel by appropriate retaining means such as springs 32, 34. The mandrel also includes a plurality of circumferentially spaced first longitudinal grooves 36 and a like plurality of circumferentially spaced second longitudinal grooves 38. The grooves maintain the circumferential positioning of the first and second forming members during axial movement of the mandrel. Further, the first and second forming members 28, 30, are respectively tapered to fit together in circumferentially abutting, axially-aligned relationship when the mandrel is moved from a first position as shown in FIG. 1 to a second position as shown in FIG. 2.

Figure 3:
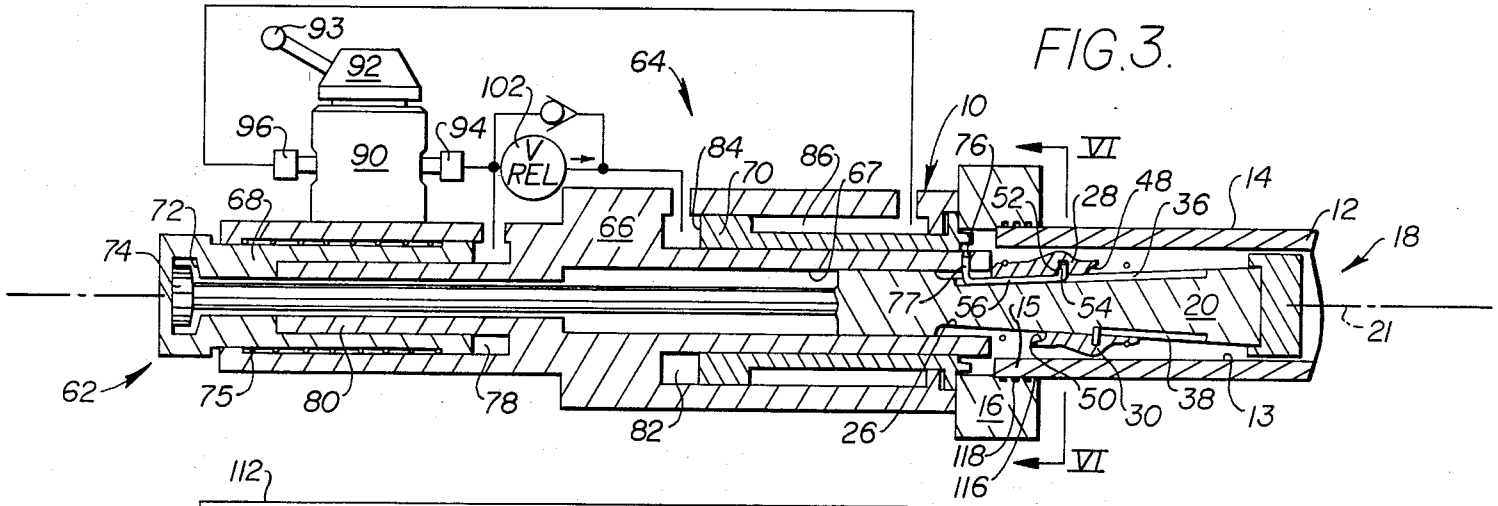
FIG. 3 is a diagrammatic and sectional view of the tube expander of the present invention with forming members of the expander in a radially retracted, axially offset, and non-abutting relationship.
Figure 4:
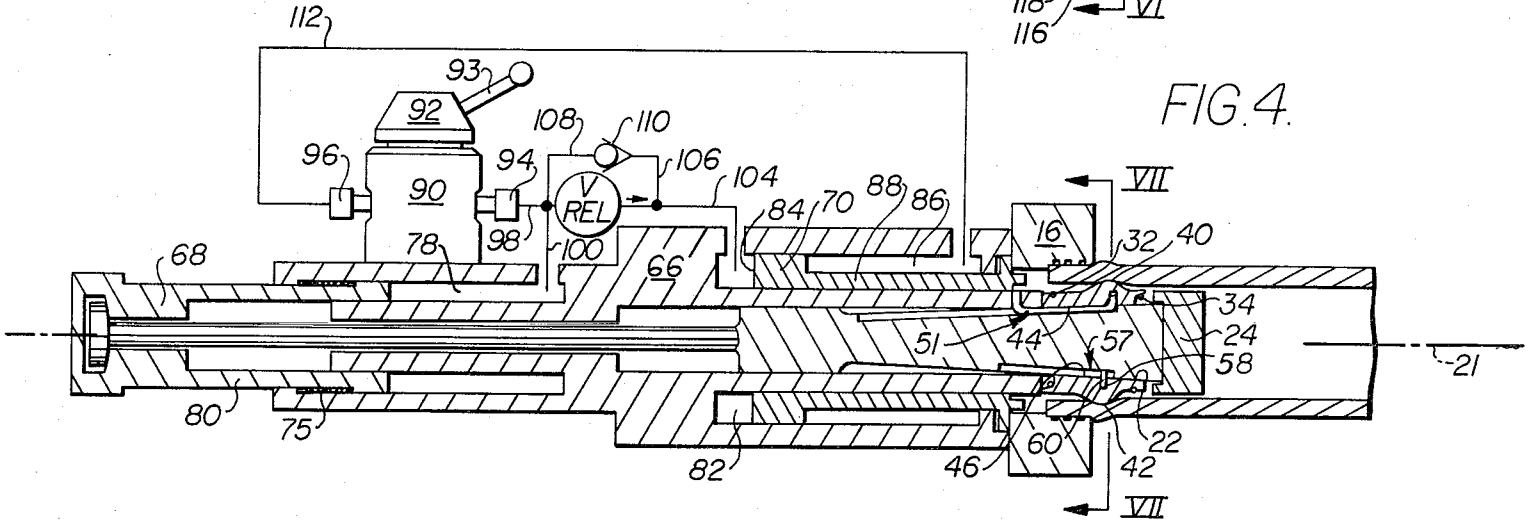
FIG. 4 is a diagrammatic and sectional view of the tube expander of the present invention with the forming members in a radially expanded, axially aligned, and abutting relationship and positioned at the beginning of the tube deformation stroke.
Figure 5:
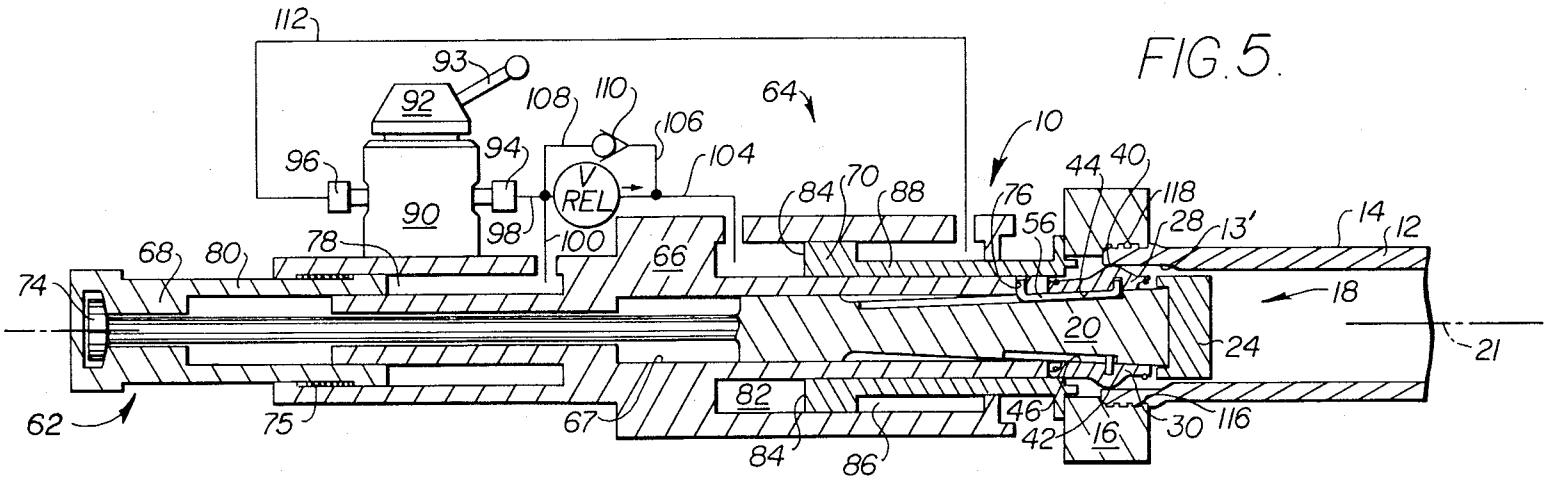
FIG. 5 is a diagrammatic and sectional view of the tube expander of the present invention with the forming members in a radially expanded axially aligned, and abutting relationship and positioned at the completion of the tube deformation stroke.
Figure 7:
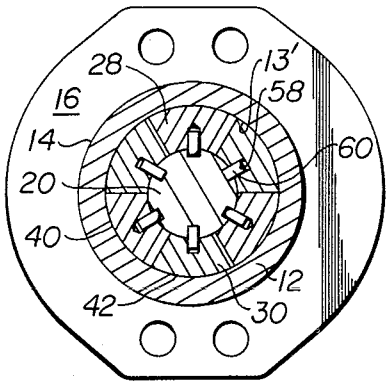
FIG. 7 is a sectional view of the tube expander of the present invention taken along the line VII—VII of FIG. 4.
Figure 6:
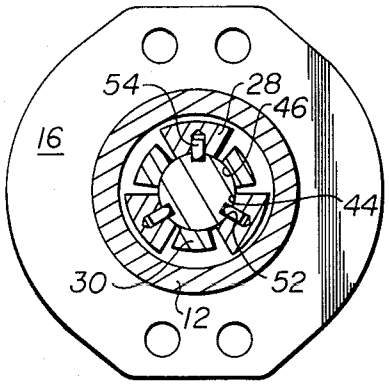
FIG. 6 is a sectional view of the tube expander of the present invention taken along the line VI—VI of FIG. 3.

As better shown in FIGS. 3–7, the first and second forming members 28,30 are arcuately shaped and have respectively outer workpiece-contacting surfaces 40,42 and, also respectively, radially inner mandrel-contacting surfaces 44,46. The workpiece-contacting surfaces 40,42 have identical radii of curvature about the mandrel centerline 21 in transverse section, of a dimension sufficient for deforming the tube 10 to the requisite shape shown in FIGS. 4, 5, and 7. Similarly, the respective radially inner mandrel-contacting surfaces 44,46 are part frustro-conically shaped to match the tapered surface of the mandrel 20 when the forming members are in an abutting axially-aligned relationship corresponding to the second position illustrated in FIGS. 2, 4, and 7, and at the completion of the forming operation as shown in FIG. 5. The first and second forming members 28,30, also have reliefs 48,50 formed in the inner surfaces 44,46 at axially opposed ends to provide clearance respectively for springs 34,32, when the members are brought together. Further, means 51 are provided for circumferentially positioning each of the first forming members 28, the means 51 includes a hook 56 having a first upturned end 54, the longitudinal groove 36 for receiving the hook 56, and a centrally-disposed recess 52 in the mandrel-contacting surface 44 for receiving the upturned end 54 of a hook. Similarly, means 57 is shown for circumferentially positioning the second forming members 30. The means 57 includes a guide pin 60 disposed within the aforementioned second longitudinal grooves 38, and pressably received in a centrally-disposed recess 58 in the mandrel-contacting surface 46.

Referring specifically now to FIGS. 3, 4, and 5, a proximal end 62 of the expander 10 includes an actuator 64 for axially translating the mandrel 20. The actuator has a housing 66, defining a central bore 67 and includes a first piston 68 and a second piston 70 within the housing. The first piston 68 includes in the head thereof, a centrally disposed spherical seat 72 for receiving a knob 74 at the proximal end of mandrel 20. The first piston is continuously biased to the first position in which the mandrel 20 is extended into the tube 12 as illustrated in FIG. 3, by a spring 75. Further, in the first position of FIG. 3, a portion of the housing 66 and a portion of the second piston 70 abuts the flange 16. The housing 66 has a plurality of recesses 76 opening inwardly on the central bore 67 for individually receiving an upturned end 77 of the hooks 56.

The actuator 64 also includes a first hydraulic chamber 78 formed between the housing 66 and an annular portion 80 of the first piston 68, a second hydraulic chamber 82 formed between housing 66 and a head 84 of the second piston 70, and a third hydraulic chamber 86 formed between the housing and an annular portion 88 of the second piston.

A hydraulic pump 90 having a manually operated control valve 92, a lever 93 connected to the valve, and ports 94,96 incorporated therewith is mounted on the housing 66. Port 94 is in fluid communication with the first hydraulic chamber 78 via lines 98 and 100 and with the second hydraulic chamber 82 via line 98, a relief valve 102 and a line 104. A bypass circuit, including lines 106,108 and check valve 110 permits a return flow of fluid from chamber 82 to line 98 and hence to port 94. Port 96 is in fluid communication with the third hydraulic chamber 86 via line 112.

When the control valve 92 is positioned as shown in FIG. 3, fluid pressure is supplied at port 96, consequently pressurizing line 112 and chamber 86. Port 94 is open to receive fluid from the first hydraulic chamber 78 via lines 98 and 100, and from the second chamber 82 via lines 104, 106, check valve 110 and lines 108,98. Consequently, chamber 86 is expanded, chambers 78 and 82 are contracted, and the mandrel 20 is extended into the tube end portion 15 as shown in FIG. 3.

Mandrel movement from this first described position to second or partially retracted position shown in FIG. 4 is accomplished by moving lever 93 on the control valve 92 to direct a supply of pressurized fluid to port 94 and consequently pressurize lines 98,100 and chamber 78. As fluid enters chamber 78, piston 68 is urged against the spring 75 compressing the spring and positioning piston 68 and mandrel 20 connected thereto, as shown in FIG. 4. After fluid presure reaches a predetermined limit in chamber 78, relief valve 102 opens and permits a flow of pressurized fluid to enter the second hydraulic chamber 82. As illustrated in FIG. 5 pressurization of chamber 82 results in the displacment of the housing 66, first piston 68, and the mandrel 20 with respect to the second piston 70 to a third or final position. Port 96 is open to receive the return flow of fluid, displaced from chamber 86.

Industrial Applicability

In operation, the expander 10 is cycled to extend the mandrel 20 as shown in FIGS. 1 and 3. In this position, the first forming members 28 are axially spaced on the mandrel from the second forming members 30. The hooks 56 maintain the first forming members in abutting, but radially displaceable relationship with the housing 66. The first forming members are radially contracted by spring 32 at a position near the lesser or second diameter portion 26 of the mandrel.

The second forming members are circumferentially positioned by guide pins 60 and radially maintained in such circumferential spacing on the mandrel by spring 34, being free of any direct connection to the housing are therefore free to generally move with the mandrel 20. This freedom of movement permits the second forming members to slide towards the first forming members and in cooperation with the spring 34, be radially reduced to a diameter sufficient for insertion into the tube end portion 15. Further, when the first position, the housing 66 and the second piston 70 abuts the flange 16.

After insertion, in the manner just described, lever 93 is moved to the position shown in FIG. 4, chamber 78 is pressurized, and mandrel 20 is retracted to the second position as illustrated in FIGS. 2 and 4. The first and second forming elements are now abutting and axially aligned so that the respective mandrel-contacting surfaces 44,46 mate with the mandrel 20 and the workpiece-contacting surfaces 40,42 are in substantially continuous circumferential contact with the inner bore 13 of the tube 12.

Upon expansion of the first and second forming members 28,30, as a result of the aforementioned retraction of mandrel 20, the tube inner bore 13 is slightly deformed and provides resistance to further retraction of the mandrel. At this point, the pressure in chamber 78 and lines 100,98 increases to a value sufficient to open relief valve 102 and pressurize line 104 and chamber 82. The housing 66, including first piston 68 and mandrel 20 attached thereto, is urged away from flange 16, while the second piston 70 is maintained in contact with the end of tube 12. In this manner, the mandrel 20, supports and maintains the first and second forming members 28,30 in a radially expanding abutting relationship, in axial alignment with each other as the mandrel is withdrawn from the tube.

During retraction of the mandrel from the second position of FIG. 4 to the third position illustrated in FIG. 5, the workpiece-contacting surfaces 40,42 of the forming members exert sufficient radial force against the inner bore 13 of the tube 12 to expand the inner bore and extrude the outer surface 14 into conformity with a bore 116 of the flange 16.

In the example illustrated, the bore 116 of the flange has a plurality of circumferential grooves 118 formed therein to provide an improved joint between the tube and flange. The tube expander of the present invention provides sufficient radial force to extrude the outer wall surface 14 into the grooves 118.

After completion of the tube expansion operation, the tube expander 10 is withdrawn from the end of the tube. The expander is returned to the configuration of FIG. 3 by moving the control valve lever 93 to the initial position. In this manner, fluid is evacuated from chambers 78,82 and chamber 86 is again pressurized. The first piston 68 is urged to its initial position by spring 75, thereby extending the mandrel into position for insertion into the next tube end.

Other aspects, objects and advantages of this invention can be obtained from a study of the drawings, the disclosure and the appended claims.

We claim:

1. A method of expanding a workpiece (12) having a bore (13) therein comprising:

Step (a) inserting a tube expander (10) having first and second forming members (28,30) into the bore (13) of the workpiece (12) with the first and second forming members (28,30) being slidably disposed in an axially offset, reduced diameter condition on a tapered mandrel (20);

Step (b) urging the first and second forming members (28,30) into an axially aligned, enlarged diameter condition in mating contact with the mandrel (20) and providing a continuous annular forming surface (40,42); and Step (c) axially moving the forming members (28,30) within the bore (13).

2. A tube expander (10), comprising:

a housing (66) having a central bore (67);

a tapered mandrel (20) at least partially disposed within the bore (67) of said housing (66);

a plurality of first forming members (28) each having a radially inwardly disposed mandrel contacting surface (44), said first forming members (28) being slidably mounted on said mandrel (20) and radially displaceably connected to the housing (66);

a plurality of second forming members (30) each having a radially inwardly disposed mandrel contacting surface (46), said second forming members being slidably mounted on said mandrel (20) and movable from a collapsed position axially offset from said first forming members (28) to a second expanded position of alignment with said first forming members (28) and forming therewith a substantially continuous annular forming surface;

means (51) for circumferentially positioning said first forming member (28) on said mandrel (20);

means (57) for circumferentially positioning said second forming member (30) on said mandrel (20); and spring means (32,34) for radially maintaining said first and second forming members (28,30) in contact with said mandrel (20).

3. The tube expander (10) of claim 2 wherein said mandrel-contacting surfaces (44,46) respectively of said first and second forming members (28,30) are frustroconically shaped and contoured to match the taper of said mandrel (20) at said second position of alignment between said first and second members (28,30).

4. The tube expander (10) of claim 2 wherein said means (51) for circumferentially positioning said first forming member (28) on said mandrel (20) includes a first longitudinal groove (36) in the mandrel (20), a centrally disposed recess (52) in the mandrel-contacting surface (44) of said first forming member (28), a recess (76) in the central bore (67) of the housing (66), a hook (56) having upturned ends (54,77) for respectively engaging recesses (52,76), said hook being substantially disposed within said groove (36).

5. The tube expander (10) of claim 2 wherein said means (57) for circumferentially positioning said second member (30) on said mandrel (20) includes a second longitudinal groove (38) in the mandrel (20), a centrally disposed recess (58) in the mandrel-contacting surface (46) of said second forming member (30), and a guide pin (60) pressably received within said recess (58), said guide pin (60) being at least partially disposed within said groove.

* * * * *